US010364006B2

(12) United States Patent
Heinen

(10) Patent No.: US 10,364,006 B2
(45) Date of Patent: Jul. 30, 2019

(54) MODIFIED $CO_2$ CYCLE FOR LONG ENDURANCE UNMANNED UNDERWATER VEHICLES AND RESULTANT CHIRP ACOUSTIC CAPABILITY

(71) Applicant: Raytheon Company, Waltham, MA (US)

(72) Inventor: Gregory W. Heinen, Lowell, MA (US)

( * ) Notice: Subject to any disclaimer, the term of this patent is extended or adjusted under 35 U.S.C. 154(b) by 599 days.

(21) Appl. No.: 15/091,415

(22) Filed: Apr. 5, 2016

(65) Prior Publication Data

US 2017/0283021 A1 Oct. 5, 2017

(51) Int. Cl.
*B63G 8/00* (2006.01)
*F01K 1/12* (2006.01)
(Continued)

(52) U.S. Cl.
CPC ..... *B63G 8/08* (2013.01); *B63G 8/001* (2013.01); *F01D 15/045* (2013.01);
(Continued)

(58) Field of Classification Search
CPC ..... B63B 2209/00; B63G 8/001; B63G 8/08; B63G 2008/002; F01D 15/045;
(Continued)

(56) References Cited

U.S. PATENT DOCUMENTS 952,452 A 3/1910 Leon
1,108,192 A 8/1914 LaGergren
(Continued)

FOREIGN PATENT DOCUMENTS

DE 215277 C 12/1906
EP 2660433 A1 11/2013
(Continued)

OTHER PUBLICATIONS

International Search Report and Written Opinion of the International Searching Authority for International Patent Application No. PCT/US2017/017499 dated May 29, 2017, 13 pages.
(Continued)

*Primary Examiner* — Nathaniel E Wiehe

(57) ABSTRACT

A carbon dioxide cycle power generation system includes storage collectively storing portions of carbon dioxide liquid and gas and a transfer connection selectively directing flow of the carbon dioxide through a turbine. The system cycles between different seawater depths in order to employ at least one of seawater pressure and seawater temperature in creating the carbon dioxide flow. Inlet/outlet control valves on variable volume tanks, positioned below movable pistons within the respective tank, selectively allow seawater into or out of a lower portion of the respective tank below the piston to pressurize the carbon dioxide therein relative to the carbon dioxide within the other tank when at depth rather than near the surface. Inhibited versus uninhibited heat transfer between storage portions and the seawater allows different seawater temperatures at depth and near the surface to create the carbon dioxide flow. Acoustic communications may be driven concurrent with the turbine.

22 Claims, 15 Drawing Sheets

(51) Int. Cl.

| | |
|---|---|
| ***F01K 25/10*** | (2006.01) |
| ***F01D 15/04*** | (2006.01) |
| ***F01K 15/04*** | (2006.01) |
| ***B63G 8/08*** | (2006.01) |
| ***F01D 25/14*** | (2006.01) |
| ***F01K 13/02*** | (2006.01) |
| ***F01K 25/08*** | (2006.01) |

(52) U.S. Cl.

CPC ..... *F01D 25/145* (2013.01); *F01K 1/12* (2013.01); *F01K 13/02* (2013.01); *F01K 15/04* (2013.01); *F01K 15/045* (2013.01); *F01K 25/08* (2013.01); *F01K 25/103* (2013.01); *B63B 2209/00* (2013.01); *B63G 2008/002* (2013.01); *F05D 2210/12* (2013.01); *F05D 2220/31* (2013.01); *F05D 2220/76* (2013.01); *F05D 2260/10* (2013.01); *F05D 2260/231* (2013.01); *F05D 2260/42* (2013.01); *F05D 2270/05* (2013.01)

(58) Field of Classification Search

CPC ..... F01D 25/145; F01K 1/12; F01K 13/02; F01K 15/04; F01K 15/045; F01K 25/08; F01K 25/103; F05D 2210/12; F05D 2220/31; F05D 2220/76; F05D 2260/10; F05D 2260/231; F05D 2260/42; F05D 2270/05

USPC ..... 60/398

See application file for complete search history.

(56) References Cited

U.S. PATENT DOCUMENTS

| | | | | |
|---|---|---|---|---|
| 1,315,267 | A | | 9/1919 | White |
| 1,361,561 | A | | 12/1920 | Yancey |
| 1,421,369 | A | | 7/1922 | Ardo |
| 1,710,670 | A | | 4/1929 | Bonney |
| 2,000,746 | A | | 5/1935 | Dray |
| 2,381,478 | A | | 9/1942 | Zukor |
| 2,537,929 | A | | 1/1951 | Daly et al. |
| 2,642,693 | A | | 6/1953 | Broady |
| 2,720,367 | A | | 10/1955 | Doolittle |
| 2,750,794 | A | | 6/1956 | Downs |
| 2,783,955 | A | | 3/1957 | Fitz Patrick |
| 2,823,636 | A | | 2/1958 | Gongwer |
| 2,826,001 | A | | 3/1958 | Presnell |
| 2,845,221 | A | | 7/1958 | Vine et al. |
| 2,911,792 | A | | 11/1959 | Rinia |
| 2,964,874 | A | | 12/1960 | Armando |
| 3,157,145 | A | | 11/1964 | Farris et al. |
| 3,376,588 | A | | 4/1968 | Berteaux et al. |
| 3,698,345 | A | | 10/1972 | Kreitner |
| 3,815,555 | A | | 6/1974 | Tubeuf |
| 3,818,523 | A | | 6/1974 | Stillman |
| 3,901,033 | A | | 8/1975 | McAlister |
| 3,918,263 | A | | 11/1975 | Swingle |
| 4,403,154 | A | | 9/1983 | Reale et al. |
| 4,445,818 | A | | 5/1984 | Ohsaki et al. |
| 4,529,120 | A | * | 7/1985 | Fleshman, Jr. ..... F23N 1/085 110/216 |
| 4,577,583 | A | | 3/1986 | Green, II |
| 4,850,551 | A | | 7/1989 | Krawetz et al. |
| 4,919,637 | A | | 4/1990 | Fleischmann |
| 5,134,955 | A | | 8/1992 | Manfield |
| 5,291,847 | A | | 3/1994 | Webb |
| 5,303,552 | A | | 4/1994 | Webb |
| 5,579,640 | A | | 12/1996 | Gray, Jr. et al. |
| 5,615,632 | A | | 4/1997 | Nedderman, Jr. |
| 6,142,092 | A | | 11/2000 | Coupland |
| 6,263,819 | B1 | | 7/2001 | Gorustein et al. |
| 6,328,622 | B1 | | 12/2001 | Geery |
| 8,046,990 | B2 | | 11/2011 | Bollinger et al. |
| 8,069,808 | B1 | | 12/2011 | Imlach et al. |
| 8,117,842 | B2 | | 2/2012 | McBride et al. |
| 8,205,570 | B1 | | 6/2012 | Tureaud et al. |
| 2006/0059912 | A1 | | 3/2006 | Romanelli et al. |
| 2007/0186553 | A1 | | 8/2007 | Lin |
| 2008/0088171 | A1 | | 4/2008 | Cheng |
| 2009/0178603 | A1 | | 7/2009 | Imlach et al. |
| 2009/0277400 | A1 | | 11/2009 | Conry |
| 2010/0192575 | A1 | | 8/2010 | Ai-Mayahi et al. |
| 2010/0327605 | A1 | | 12/2010 | Andrews |
| 2011/0051880 | A1 | | 3/2011 | Ai-Mayahi et al. |
| 2011/0101579 | A1 | | 5/2011 | Polakowski et al. |
| 2011/0167825 | A1 | | 7/2011 | Mauran et al. |
| 2012/0091942 | A1 | | 4/2012 | Jones et al. |
| 2012/0289103 | A1 | | 11/2012 | Hudson et al. |
| 2013/0068973 | A1 | | 3/2013 | van Ruth |
| 2013/0180243 | A1 | | 7/2013 | Hurtado |
| 2018/0119990 | A1 | | 5/2018 | Alsadah |

FOREIGN PATENT DOCUMENTS

| | | | |
|---|---|---|---|
| EP | 2698506 | A1 | 2/2014 |
| GB | 235363 | A | 6/1925 |
| GB | 541775 | A | 12/1941 |
| GB | 658070 | A | 10/1951 |
| GB | 2422877 | A | 8/2006 |
| WO | 2011000062 | A1 | 1/2011 |

OTHER PUBLICATIONS

Mosca, et al.; "Low-Frequency Acoustic Source for AUV Long-Range Communication"; iXSea, France; JAMSTEC, Japan; no date; prior to filing date; 9 pp.

Jack A. Jones et al., "Novel Thermal Powered Technology for UUV Persistant Surveillance", California Institute of Technology, Feb. 10, 2006, 11 pgs.

Terry Huntsberger et al., "Slocum-TREC Thermal Glider", California Institute of Technology, Jan. 31, 2012, 16 pgs.

Terry Huntsberger et al., "Advanced Energy Storage System for Thermal Engines", California Institute of Technology, Jan. 31, 2013, 16 pgs.

Yi Chao, "Diurnal Variability Part I: Global 1-km SST (G1SST) Part II:GHRSST-DV-Argo Obs. System", California Institute of Technology, Feb. 28, 2011, 19 pgs.

NASA,"Utilizing Ocean Thermal Energy in a Submarine Robot", NASA's Jet Propulsion Laboratory, NASA Tech Briefs NPO-43304, Dec. 18, 2008, 4 pgs.

T. Shimura et al., "Long-Range Rime Reversal Communication in Deep Water: Experimental Results", J. Acoust. Soc. Am. 132 (1), Jul. 2012, [http://dx.doi.org/10.1121/1.4730038], Jun. 19, 2012, 5 pgs.

Gregory W. Heinen, "Modified CO2 Cycle for Long Endurance Unmanned Underwater Vehicles and Resultant Chirp Acoustic Capability", U.S. Appl. No. 15/091,415, filed Apr. 5, 2016.

Gregory W. Heinen et al., "Apparatus and Method for Periodically Charging Ocean Vessel or Other System Using Thermal Energy Conversion", U.S. Appl. No. 15/173,178, filed Jun. 3, 2016.

Gregory W. Heinen, "Hydraulic Drives for Use in Charging Systems, Ballast Systems, or Other Systems of Underwater Vehicles," U.S. Appl. No. 15/173,214, filed Jun. 3, 2016.

Gregory W. Heinen, et al., "Systems and Methods Supporting Periodic Exchange of Power Supplies in Uderwater Vehicles or Other Devices," U.S. Appl. No. 15/264,399, filed Sep. 13, 2016.

Bowman, M.F., "A Passive Capture Latch for Odyssey-Class AUVs," Technical Report WHOI-98-12, Jun. 12, 1998, 91 pages, publisher Woods Hole Oceanographic Institution, Woods Hole, MA.

Singh, Hanumant, et al., "Docketing for an Autonomous Ocean Sampling Network," IEEE Journal of Oceanic Engineering, Oct. 2001, pp. 498-514, vol. 26, No. 4, publisher IEEE, Piscataway, New Jersey.

Bowen, Andrew D., et al., "The Nereus Hybrid Underwater Robotic Vehicle for Global Ocean Science Operations to 11,000m Depth," 2008, 10 pages, publisher IEEE, Piscataway, New Jersey.

Hardy, Tim, et al., "Unmanned Underwater Vehicle (UUV) deployment and retrieval considerations for submarines," Paper on UUV

(56) References Cited

OTHER PUBLICATIONS

Development and Retrieval Options for Submarines, Apr. 2008, pp. 1-15, publisher BMT Defense Services Ltd., Bath, United Kingdom.
Cowen, Steve, "Flying Plug: A Small UUV Designed for Submarine Data Connectivity (U)," Abstract, 1997, 21 pages, publisher PN.
Gish, Lynn Andrew, "Design of an AUV Recharging System," 2004, 134 pages, publisher Massachusetts Institute of Technology, Cambridge, Massachusetts.
Vandenberg, Troy D., "Manning and Maintainability of a Submarine Unmanned Undersea Vehicle (UUV) Program: A Systems Engineering Case Study," Thesis, Sep. 2010, 137 pages, publisher Naval Postgraduate School, Monterey, California.
Griffiths, Gwyn, "Technology and Applications of Autonomous Underwater Vehicles," 2003, pp. 93-108, publisher Taylor & Franscis, New York, NY.
Galletti Di Cadilhac, Robin, "Docketing System," 2003, pp. 93-108, publisher Taylor & Franscis, New York, NY.
Singh, Hanumant, et al., "AOSN MURI: Docketing for an Autonomous Ocean Sampling Network," Program #: ONR-322 OM/AOSN N00014-95-1-13166, 1998, 6 pages, available at http://www.whoi.edu/DSL/hanu/.
International Search Report and Written Opinion of the International Search Authority for PCT Patent Application No. PCT/US2017/016976 dated Feb. 12, 2018, 18 pages.
Foreign Communication from Related Counterpart Application, PCT Application No. PCT/US2016/062518, International Search Report and the Written Opinion of the International Searching Authority dated May 18, 2017, 12 pages.

* cited by examiner

MODIFIED $CO_2$ CYCLE FOR LONG ENDURANCE UNMANNED UNDERWATER VEHICLES AND RESULTANT CHIRP ACOUSTIC CAPABILITY

TECHNICAL FIELD

The present disclosure is directed in general to energy supplies for underwater, unmanned vehicles (UUVs), and, more particularly, to energy derivation for powering UUVs using in situ ocean resources.

BACKGROUND OF THE DISCLOSURE

Various proposals for energy supplies within Unmanned Underwater Vehicles (UUV) have proven impractical or only provide power in amounts limited to less than about 200 watts (W) at 2.2 Watt-hour (WHr) capacity. Fuel cells require large packages and substantial space for battery storage together with the demands of hydrogen logistics. Power tethers from central power plants limit vehicle range and deployment.

SUMMARY OF THE DISCLOSURE

A carbon dioxide cycle power generation system includes first and second carbon dioxide storage each configured to store a portion of carbon dioxide and including a carbon dioxide transfer connection, and a carbon dioxide transfer path between the two transfer connections configured to selectively direct a flow of at least part of the carbon dioxide through a rotor vane turbine serving as a fluid orifice. The carbon dioxide cycle power generation system cycles between different seawater depths, employing one or both of seawater pressure and seawater temperature in creating the flow of liquid or vapor carbon dioxide through the rotor vane turbine acting as a fluid orifice. In one implementation, the first and second carbon dioxide storage each comprise a variable volume hydraulic cylinder with a movable piston and an inlet/outlet control valve positioned below the movable piston, the inlet/outlet control valve selectively allowing seawater into or out of a lower portion of the respective variable volume tank below the movable piston to pressurize a respective one of the first or second portions of carbon dioxide relative to the other when the carbon dioxide cycle power generation system is at a first depth. In another implementation, the first portion of the carbon dioxide is contained within an annular region surrounding a central region with uninhibited heat transfer between the respective first portion of the carbon dioxide and the seawater, while the second carbon dioxide storage comprises an insulated, water jacketed tank inhibiting heat transfer between the respective second portion of the carbon dioxide and the seawater. One or both of the first and second portions of the carbon dioxide may comprise both carbon dioxide liquid and carbon dioxide gas. An unmanned underwater vehicle (UUV) including the carbon dioxide cycle power generation system is operated on electrical power generated by the carbon dioxide cycle power generation system and stored in one or more batteries within the UUV. A two carrier chirp communications system is coupled to the carbon dioxide transfer path and employs a pulse wave of at least part of the carbon dioxide liquid or vapor flow through the turbine as a first carrier and to generate a chirp signal on a second carrier that is one of combined and interleaved with the first carrier to generate an output pressure pulse communications signal. The two carrier chirp communications system comprises a pressure pulse resonator coupled to the flow of the at least part of the carbon dioxide liquid or vapor through the turbine, an annular array of frequency resonators adjacent the pressure pulse resonator, and a Helmholtz resonator external to the annular array of frequency resonators. The UUV employs the two carrier chirp communications system to transmit data to remote receivers, and/or may be tethered and configured to cycle between depths according to a selected one of a plurality of different depth cycles.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
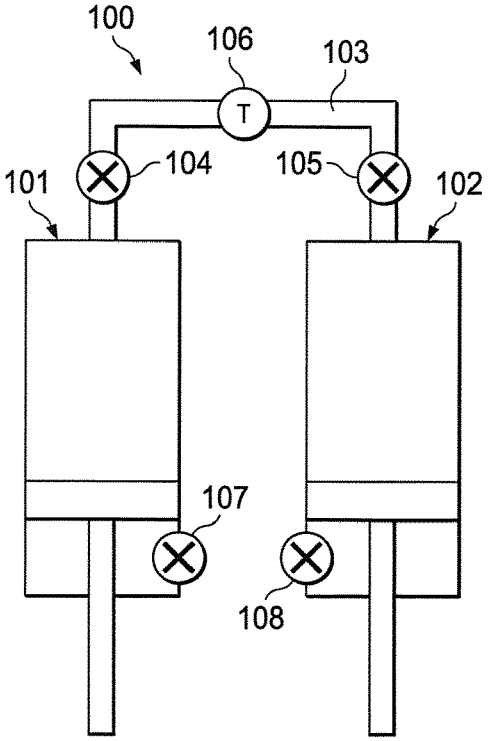
FIG. 1 is a diagram illustrating a variable internal and external volume carbon dioxide ($CO_2$) cycle power generation system in accordance with embodiments of the present disclosure.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below. Additionally, unless otherwise specifically noted, articles depicted in the drawings are not necessarily drawn to scale.

The present disclosure presents an innovative approach to providing power to a UUV, while providing long range underwater communications capability through its turbine power converter. The approach of the present disclosure provides power for extended endurance underwater missions, providing up to or exceeding 500 Watts (W) of power for a 33 minute power cycle using about 20 pounds (lb) of carbon dioxide. Carbon dioxide is employed at six times the density of air through a typical air motor providing density and temperature benefits. The power generation system disclosed also provides in situ power for communications, and requires only carriage of carbon dioxide, at lower pressures than required for the agents employed in fuel cells. In addition, significantly less pressure is required from the vessels than for fuel cells: on the order of about 1200 pounds per square inch (psi) versus at least 8,000 psi or more.

Power conversion in accordance with the present disclosure is versatile, with each of three approaches all suitable for the carbon dioxide power generation cycle employed: a vane rotor; an impulse turbine with fluid orifice; and an axial flow turbine with a choked flow (via an orifice) input in all cases and optionally multiple stages. The prime power cycle of the present disclosure can drive a generator and charge batteries using ocean thermals and compression (compressive work) in the trans-critical carbon dioxide gas/liquid pressure-volume cycle. One version of carbon dioxide power generation cycle employed is a combined Rankine cycle and Otto cycle. The carbon dioxide cycle power generation system described is sustainable, and may operation for an estimated two years without maintenance or repair, limited primarily by the battery and comparable to most refrigeration systems.

The power produced for operation of remote UUVs yields a surplus of energy, and allows optional use of direct power (before storage losses) power drive for an acoustic resonator providing the communications carrier for UUV communications. An acoustic actuator may be operated via a high density (carbon dioxide) fluid and hydraulics. A dual carrier acoustic communications scheme may be employed in which pressure pulses are created on an acoustic oscillator. The necessary communications infrastructure requires only a two carrier system: a main carrier continuous wave (CW) that is driven by the carbon dioxide cycle and a piezo-driven digital chirp. Due to periodic dives through 600 meters (m), the communications system can operate in range of acoustic depth and channels.

FIG. 1 is a diagram illustrating a variable internal and external volume carbon dioxide ($CO_2$) cycle power generation system in accordance with embodiments of the present disclosure. Those skilled in the art will recognize that, for simplicity and clarity, some features and components are not explicitly shown, including those illustrated in connection with later figures. The carbon dioxide cycle power generation system 100 is preferably installed within a UUV such as an underwater glider, the structure of which is not shown in FIG. 1 for simplicity and clarity. The carbon dioxide cycle power generation system 100 employs two variable volume hydraulic cylinders 101 and 102, each sealed and including a movable piston therein changing the upper volume as shown. A transfer connection 103 with two transfer control valves 104 and 105 connects the upper ends of the two hydraulic cylinders 101 and 102, selectively allowing passage of carbon dioxide gas between the two hydraulic cylinders 101 and 102. Also connected to the transfer connection 103 is a turbine and chirp generator 106, described in further detail below. Fluid inlet/outlet portals (not visible in FIG. 1) are provided near the bottom of each hydraulic cylinder 101 and 102, below the pistons, and are selectively opened or closed by inlet/outlet control values 107 and 108, respectively.

At least the hydraulic cylinders 101 and 102 and the control valves 104, 105, 107 and 108 may each employ commercial, off-the-shelf (COTS) components. Hydraulic cylinders 101 and 102 are preferably rated to 3,000 pounds per square inch (psi), although the required maximum pressure will typically only be about 1,500 psi. Although the principles of the present disclosure are illustrated with reference to two hydraulic cylinders, embodiments may employ, for example, two separate hydraulic cylinders operating coordinately in place of one of the two hydraulic cylinders 101 or 102 depicted in FIG. 1.

FIGS. 1A through 1H illustrate how pressure is exploited during operation of the carbon dioxide cycle power generation system of FIG. 1. During operation, an upper volume above the piston in one hydraulic cylinder 101 will contain carbon dioxide gas 109, while a lower volume below the piston will contain seawater 110; likewise an upper volume above the piston in the other hydraulic cylinder 102 will contain carbon dioxide gas 111 while a lower volume below the piston will contain seawater 112. The amount of carbon dioxide gas 109, 111 in each cylinder 101, 102 may be approximately 10 kilograms (kg) at standard temperature and pressure. During operation, an ocean thermal energy Carnot-Brayton cycle employed by the carbon dioxide cycle power generation system 100 may produce 500 W of energy using 10 kg of carbon dioxide in each hydraulic cylinder 101, 102, for a 0.25 kilo Watt-hour (kWhr) carbon dioxide cycle power generation system.

Figure 1A:
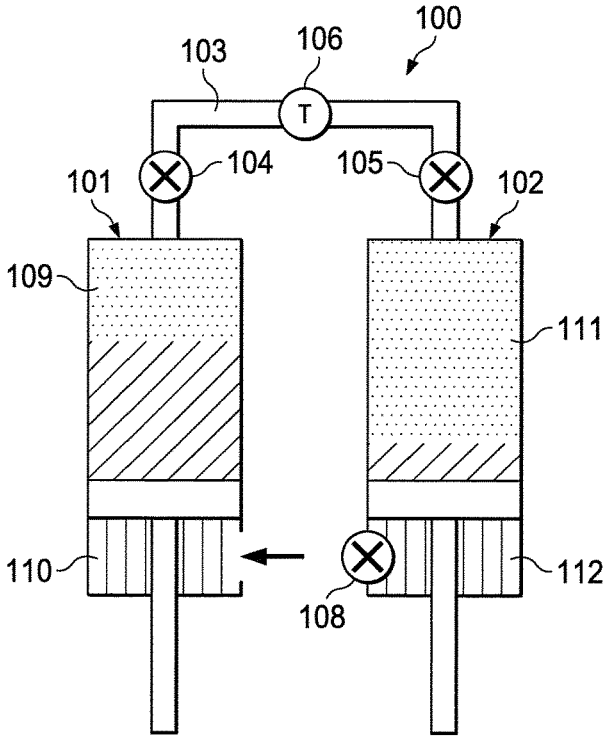
FIGS. 1A through 1H illustrate how pressure is exploited during operation of the carbon dioxide cycle power generation system of FIG. 1.
Figure 1B:
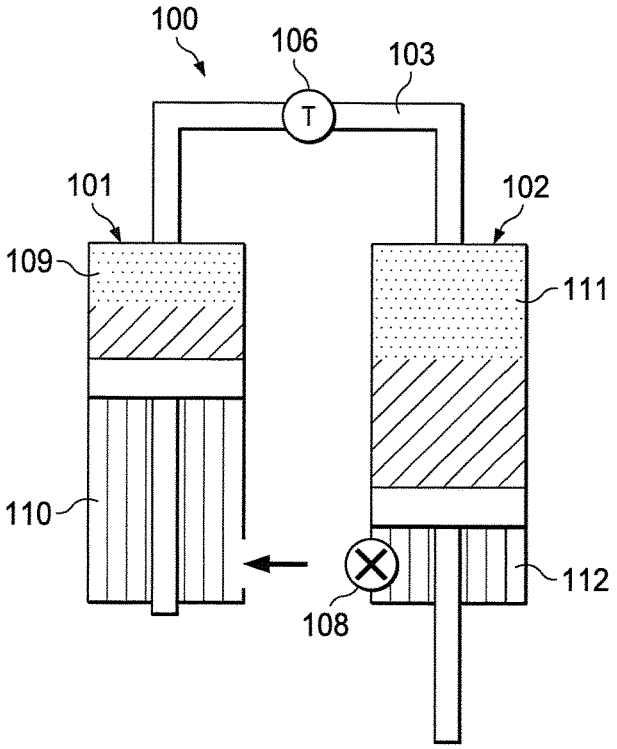

The illustrated operating cycle of the carbon dioxide cycle power generation 110 begins at an underwater depth corresponding to an external pressure or 10-20 bar, where the seawater temperature is typically 5-8 degrees Celsius (° C.). The inlet/outlet control valve 107 of hydraulic cylinder 101 is opened as shown in FIG. 1A, allowing seawater at depth to enter the lower volume of hydraulic cylinder 101. The pressure of the external seawater drives the piston within hydraulic cylinder 101 up, increasing the pressure of the carbon dioxide gas above the piston in hydraulic cylinder 101. In that manner, pressure differential of about 25-50 psi between the carbon dioxide gas 109 in hydraulic cylinder 101 (e.g., about 400 psi) and the carbon dioxide gas 111 in hydraulic cylinder 102 (e.g., about 350 psi) is created. While at the same depth, and with the inlet/outlet control valve 107 still open, the transfer control valves 104 and 105 are opened. Due to the pressure differential, carbon dioxide gas flows from hydraulic cylinder 101 through the transfer connection 103 and the turbine and chirp generator 106 into hydraulic cylinder 102. The gas flow powers the turbine and chirp generator 106, which may in turn produce electrical power for storage in batteries or the like. The UUV containing the carbon dioxide cycle power generation system 110 remains at depth (10-20 bar, 5-8° C.) until the differential pressure nears zero as illustrated in FIG. 1B. The pressure equalization results in carbon dioxide gas flowing through the transfer connection 103 from the first hydraulic cylinder 101 to the second hydraulic cylinder 102 and powering the turbine and chirp generator 106.

Figure 1C:
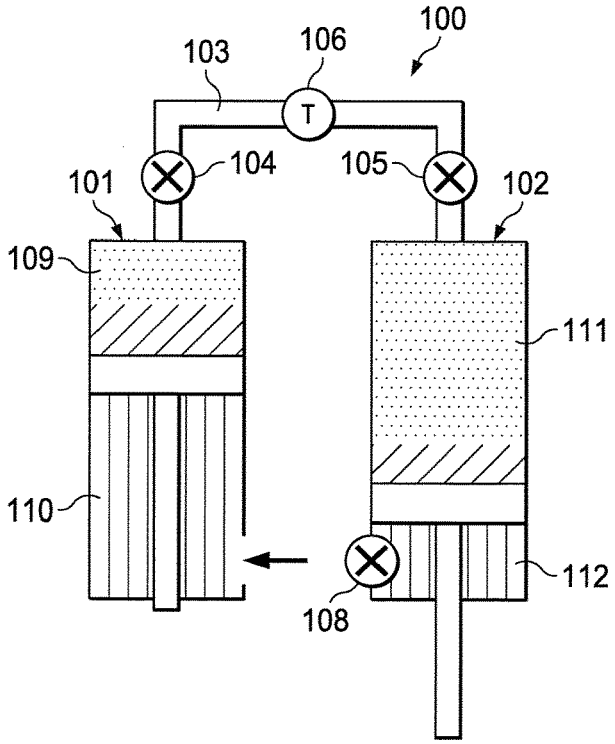
Figure 1D:
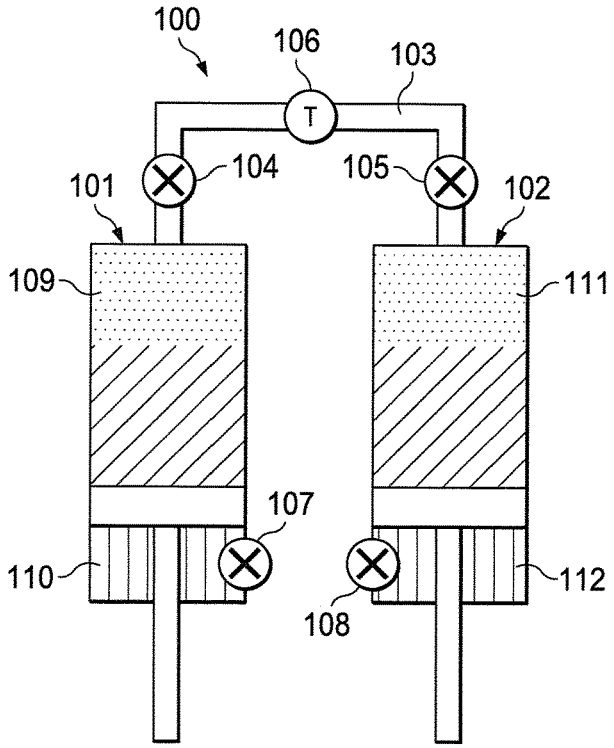

While still at depth, the transfer control valves 104 and 105 are closed as illustrated in FIG. 1C, leaving the carbon dioxide gas 109 in hydraulic cylinder 101 at least partially depleted, if not substantially or fully depleted. With the inlet/outlet control valve 107 still open as shown in FIG. 1C, the UUV containing the carbon dioxide cycle power generation system 100 surfaces, allowing the carbon dioxide gas 109 within hydraulic cylinder 101 to increase in volume, at which time the inlet/outlet control valve 107 is closed as shown in FIG. 1D. At or near the surface, the external pressure is 1-2 bar and the temperature is approximately 25-28° C. While the carbon dioxide gas above the piston within the hydraulic cylinder 101 occupies nearly the full volume of hydraulic cylinder 101, most of the total carbon dioxide gas is contained within the other hydraulic cylinder 102.

Figure 1E:
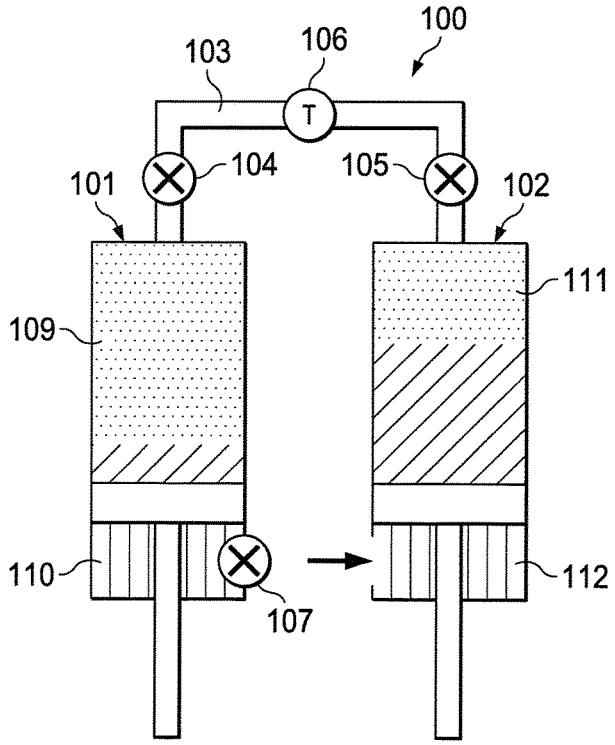
Figure 1F:
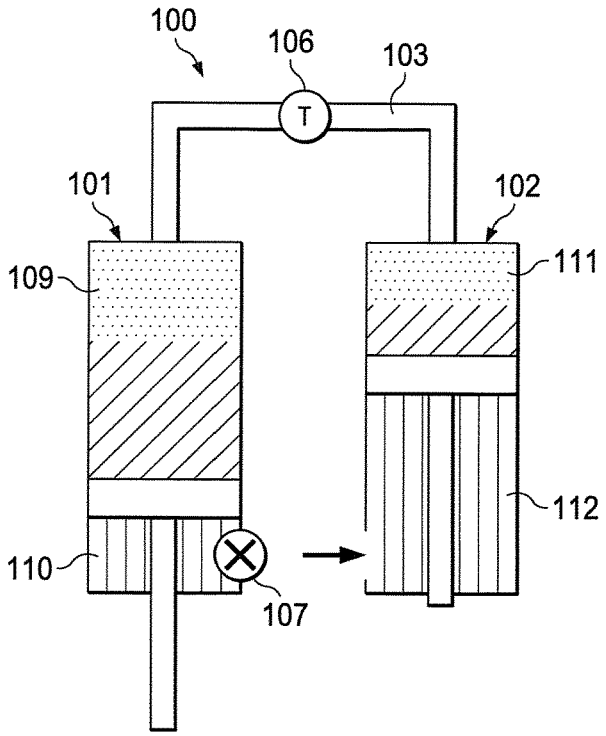

The UUV containing the carbon dioxide cycle power generation system 100 then dives to the previous depth (corresponding to 10-20 bar pressure). At that depth, the carbon dioxide cycle power generation system 100 opens the inlet/outlet control valve 108 for hydraulic cylinder 102 as shown in FIG. 1E, and subsequently opens the transfer control valves 104 and 105 as shown in FIG. 1F. The pressure differential and gas flow described above now occurs in reverse, with carbon dioxide gas flowing from hydraulic cylinder 102 through the transfer connection 103 and the turbine and chirp generator 106 into hydraulic cylinder 101, powering the turbine and chirp generator 106. The turbine and chirp generator 106 may spin counter to the direction of rotation during the previous gas transfer, or valves may be provided to automatically reroute the flow so that the turbine and chirp generator 106 spins with in the same rotational direction.

Figure 1G:
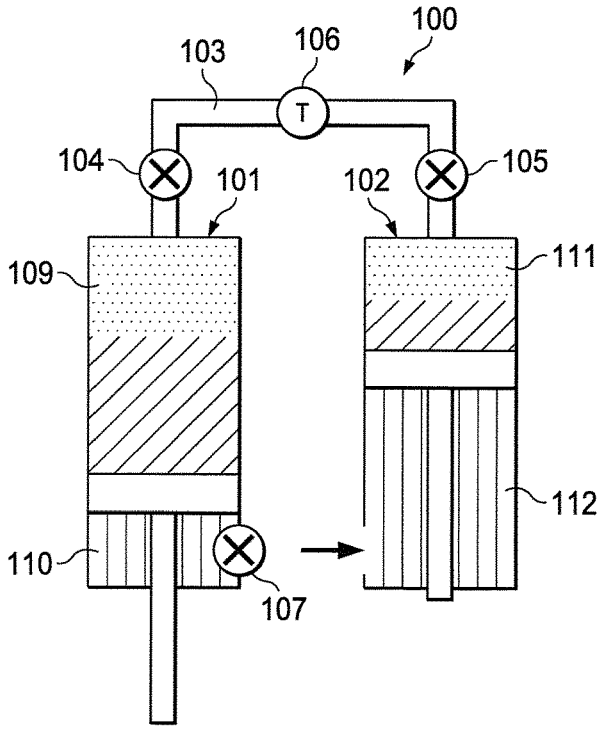
Figure 1H:
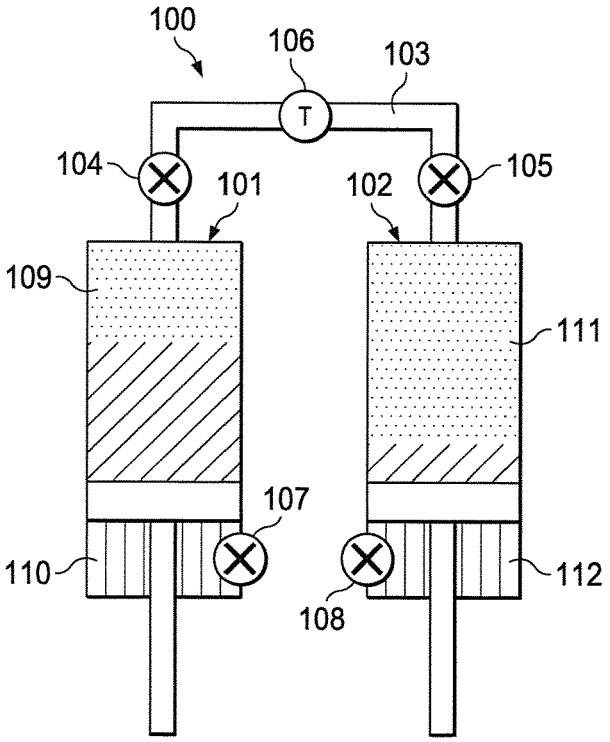

While still at depth, the transfer control valves 104 and 105 are again closed as illustrated in FIG. 1G, leaving the carbon dioxide gas 111 in hydraulic cylinder 102 at least partially if not substantially or fully depleted. With the inlet/outlet control valve 108 still open as shown in FIG. 1G, the UUV containing the carbon dioxide cycle power generation system 100 again surfaces, allowing the carbon dioxide gas 111 within hydraulic cylinder 102 to increase in volume, at which time the inlet/outlet control valve 102 is closed as shown in FIG. 1H. In contrast to the last time the UUV containing the carbon dioxide cycle power generation system 100 surfaced, the carbon dioxide gas above the piston within the hydraulic cylinder 102 occupies nearly the full volume of hydraulic cylinder 102, but most of the total carbon dioxide gas is contained within hydraulic cylinder 101. The UUV containing the carbon dioxide cycle power generation system 100 will then dive to the previous depth, and restart the cycle by opening the inlet/outlet control valve 107 as illustrated in FIG. 1A.

Figure 2:
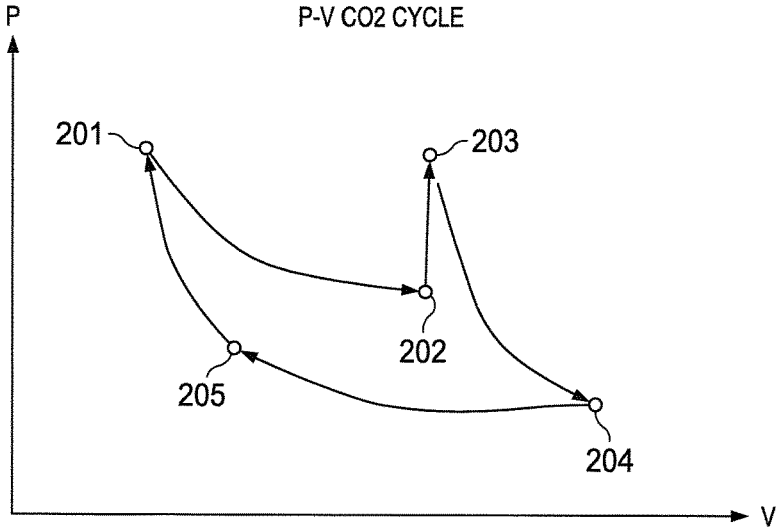
FIG. 2 is a pressure (P) versus volume (V) plot for the carbon dioxide gas cycle occurring during operation of the carbon dioxide cycle power generation system of FIG. 1.

FIG. 2 is a pressure (P) versus volume (V) plot for the carbon dioxide gas cycle occurring during operation of the carbon dioxide cycle power generation system of FIG. 1. By way of comparison, the well-known P-V diagram for steam involves a cycle that proceeds from an initial or first state in which the water vapor at a relatively high temperature $T_h$ is also at relatively high pressure and occupies a relatively low volume state within a boiler. Energy (heat) is added to cause the water vapor to undergo isothermal expansion at the temperature $T_h$ to a second state of lower pressure and higher volume. The resulting high-temperature steam is routed through a turbine, in which the water vapor underdoes adiabatic expansion from the relatively high temperature $T_h$ to a third state at still lower pressure and slightly higher volume, but at a relatively low temperature $T_l$, while concurrently producing work or a power output. The vapor then undergoes isothermal compression in a condenser or the like, outputting heat while compressing to a fourth state having smaller volume and slightly higher pressure. Finally, the vapor undergoes adiabatic compression (e.g., by being pumped) back to the original pressure, volume and temperature of the first state.

The modified carbon dioxide gas power cycle is a closed system which is analogous to the steam cycle described above. In the modified carbon dioxide gas power cycle, the initial state 201 generally corresponding to the initial state described above for the steam cycle occurs when the UUV is at or near the surface, with most of the carbon dioxide gas within hydraulic cylinder 101. The relatively warm seawater near the surface transfers heat to the carbon dioxide gas within the hydraulic cylinders 101 and 102. When the transfer control valves 104 and 105 are opened and carbon diode gas transfers from hydraulic cylinder 101 through the turbine and chirp generator 106 to hydraulic cylinder 102, the state changes to a second state 202 of reduced pressure and increased volume. Thereafter, when UUV descends and is at depth (that is, not near the surface, but instead near the lowest depth for the carbon dioxide power generation cycle described), the opening of the inlet/outlet control valve 108 for hydraulic cylinder 102 increases pressure (due to the water pressure of the seawater at depth) to state 203. When the transfer control valves 104 and 105 are opened and carbon diode gas transfers from hydraulic cylinder 102 through the turbine and chirp generator 106 to hydraulic cylinder 101, state 204 is attained, with the lowest pressure and largest volume, and at which heat transfers out from the carbon dioxide gas to the surrounding, relatively cold seawater. At depth, the seawater pressure when inlet/outlet control valve 107 on hydraulic cylinder 101 is opened causes a transition to state 205, at a slight higher pressure and much lower volume. When the UUV returns to surface depth, the state transitions back to state 201.

FIGS. 1, 1A-1G and 2 relate to a variable volume carbon dioxide cycle power generation system implementing a topping cycle. The carbon dioxide transfer between hydraulic cylinders 101 and 102 may involve either vapor or fluid (a combination of vapor and liquid). In practice, a system designed for transfer of fluid between hydraulic cylinders 101 and 102 allows for evaporation into the cold (receiving) side and expansion into the turbine. Since power generation employs a topping cycle in which there be vapor and/or liquid transfer, the variable volume approach may be preferable where there is sufficient surplus power to account for buoyancy changes. Alternatively, variable volume may be preferable as a method of automating a large portion of the ballasting work. At the surface, a small amount of dive ballast is ejected by a separate ballasting pump, but insufficient to dive the full desired depth. In the dive, one of the variable volume cylinders is allowed to vary when a depth is reached where hydrostatic pressure one of the cylinder pistons 101 or 102 but not both simultaneously would be allowed to respond to pressure, reducing the neutral buoyancy to continue diving to desired depth where the piston 101 or 102 would be controlled to stop movement or bottom out using a mechanical stop, thus stopping the ballast reduction action of the inward moving piston 101 or 102, whereupon neutral buoyancy is reached and dive motion buoyancy force would become neutral. To ascend, a separate ballasting pump would eject a small amount of ballast water and the system would begin ascent, through decreasing hydrostatic pressures, whereupon the empty cylinder piston (101 or 102) would be allowed to move in response to decreasing hydrodynamic pressure, further decreasing ballast load and ascending via an automatic response of ballasting until a depth is reached where the piston 101 or 102 is arrested and a point of neutral buoyancy is reached.

Figure 3:
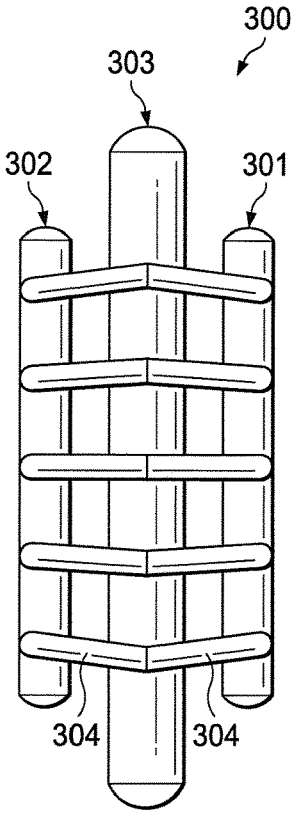
FIG. 3 illustrates the structure for an implementation of a fixed external, variable internal volume carbon dioxide cycle power generation system in accordance with one embodiment of the present disclosure.

FIG. 3 illustrates the structure for an implementation of a fixed external, variable internal volume carbon dioxide cycle power generation system in accordance with one embodiment of the present disclosure. The variable volume approach (with respect to the internal carbon dioxide) that is described above is performed with valves, which may pose obstacles to implementation in some circumstances. The carbon dioxide cycle power generation system 300 implements a fixed volume approach with respect to buoyancy. The carbon dioxide cycle power generation system 300 includes five main components: annular, variable volume carbon dioxide tanks 301 and 302 (in which carbon dioxide gas is stored in an outer, annular jacket around a central space) condense the carbon dioxide gas at depths during a charging phase (e.g., 40° F.) and absorb ocean heat at the surface (e.g., 60-70° F.); an insulated main carbon dioxide gas tank 303; a vane-rotor airmotor "turbine" through which sub-critical carbon dioxide gas is passed, driving a generator load; a set of heat exchangers in ballast tanks (not shown) that contain warmer seawater cyclically taken in at surface, replacing removed heat during the expansion phase (charging); and a set of valves in the annular tanks 301, 302 and the main tank 303, located within each cross-piece 304 between the tanks and selectively connecting the tanks via those cross-pieces. The tanks 301, 302 and 303 are vertically oriented for a vertical mission, and implement counterparts analogous to the hydraulic cylinders 101 and 102 of FIG. 1, while the counterparts to the transfer connection 103 and the transfer control valves 104 and 105 are implemented in and by the valves and cross-pieces. In contrast to the approach described above, the carbon dioxide cycle power generation system 300 exploits thermal differences between seawater near the surface and at depth, rather than pressure differences.

Figure 4:
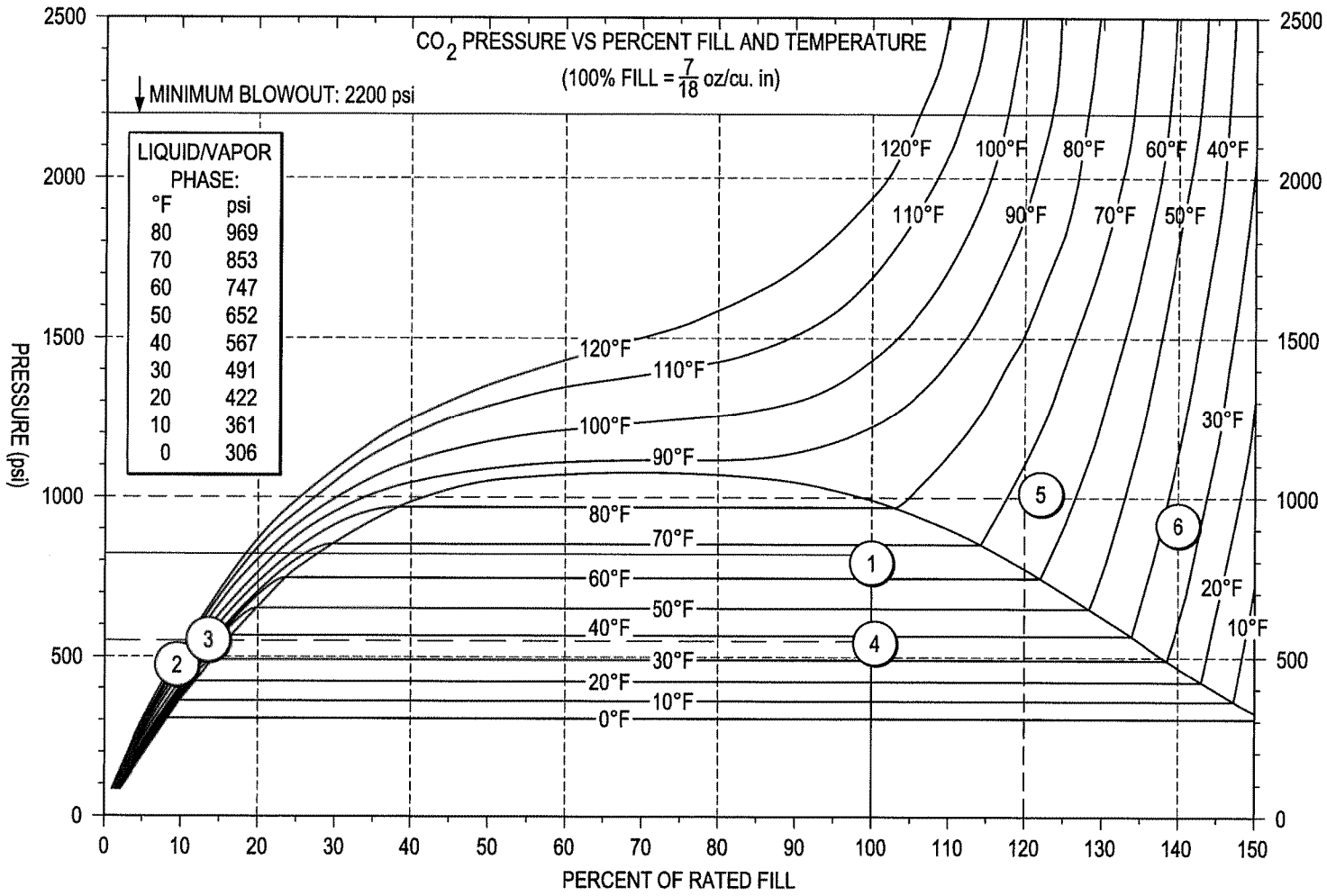
FIG. 4 is a plot of carbon dioxide gas pressure versus percent rated fill factor and temperature annotated to indicate operating points for the carbon dioxide cycle power generation system implementation of FIG. 3.

One consideration during operation of the carbon dioxide cycle power generation system 300 is the percent-rated fill factor for a non-ideal (i.e., carbon dioxide) gas, illustrated in FIG. 4, which shows the pressures, temperatures and rated fill percentage for carbon dioxide gas. For a given tank of carbon dioxide gas, the pressure will vary depending on the % rated fill, all else being equal. Typically industrial carbon dioxide gas tanks are filled to 30% liquid by volume to keep the contents out of the critical regions with expected temperature variation.

FIGS. 5A through 5D each diagrammatically illustrate conditions within the annular tanks and the main tank during the state transitions depicted in FIG. 4, together with the corresponding location of the UUV including the carbon dioxide cycle power generation system. Each of FIGS. 5A through 5D illustrates conditions 501 of the annular tanks 301, 302 and the main tank 303, and the relative position 502 of the UUV containing the carbon dioxide cycle power generation system 300.

Following FIG. 4, an example is given at points (1) to (6) that correspond to states and transitions illustrated by the dispositions in FIGS. 5A through 5D. Unlike early steam cycles, the carbon dioxide cycle power generation system 300 employs a closed cycle with one of the two tank types used for both condensing and pressurizing. Most operations in FIG. 4 are in the sub-critical region, the lower part of the figure, with ocean thermal being under 75° F. (but the valves are used to increase pressures when needed into the critical regions). In the disposition 500 of FIG. 5A, the cycle begins at surface depths near 67° F., where 100% rated fill annular tanks are directly exposed to ocean water to absorb surface heat for 3-4 hours, driving the temperature of the carbon dioxide gas in the annular tanks 301, 302 to 67° F. All of the valves are open in the annular tanks, keeping percent fill at 100%. The main tank 303 has a ballast jacket, cold from previous dive, and thus lies at low percent fill at 5-7° F., to aid in reducing center tank pressure so the center, main tank 303 can accept a transfer of warmer carbon dioxide gas from the annular tanks 301 and 302. The carbon dioxide gas in the annular tanks 301, 302 is at point (1) in FIG. 4, while the carbon dioxide gas in the main tank 303 is at point (2).

Figure 5A:
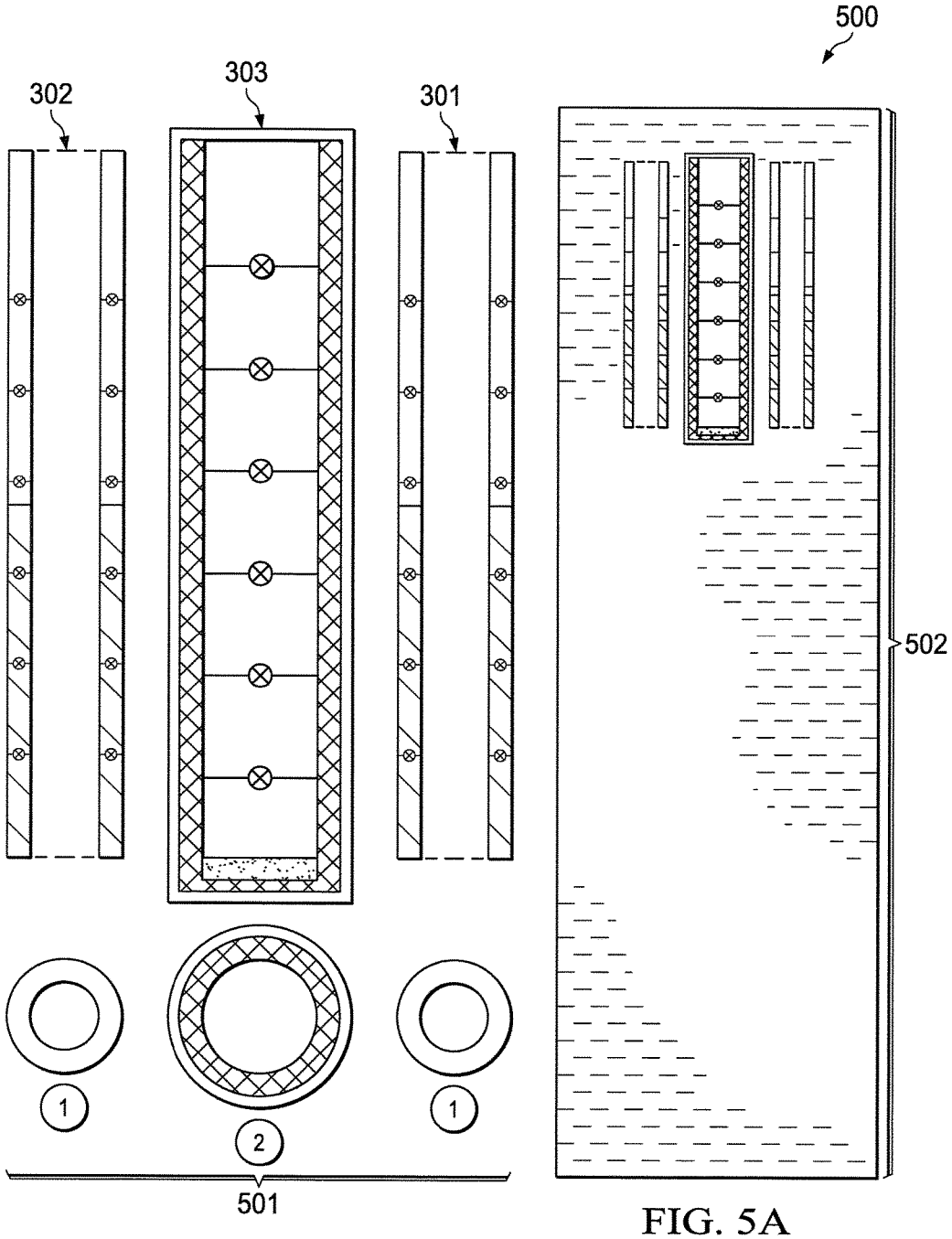
FIGS. 5A through 5D each diagrammatically illustrate conditions within the annular and main tanks of the carbon dioxide cycle power generation system implementation of FIG. 3 at the operating points and during the state transitions illustrated by FIG. 4.
Figure 5B:
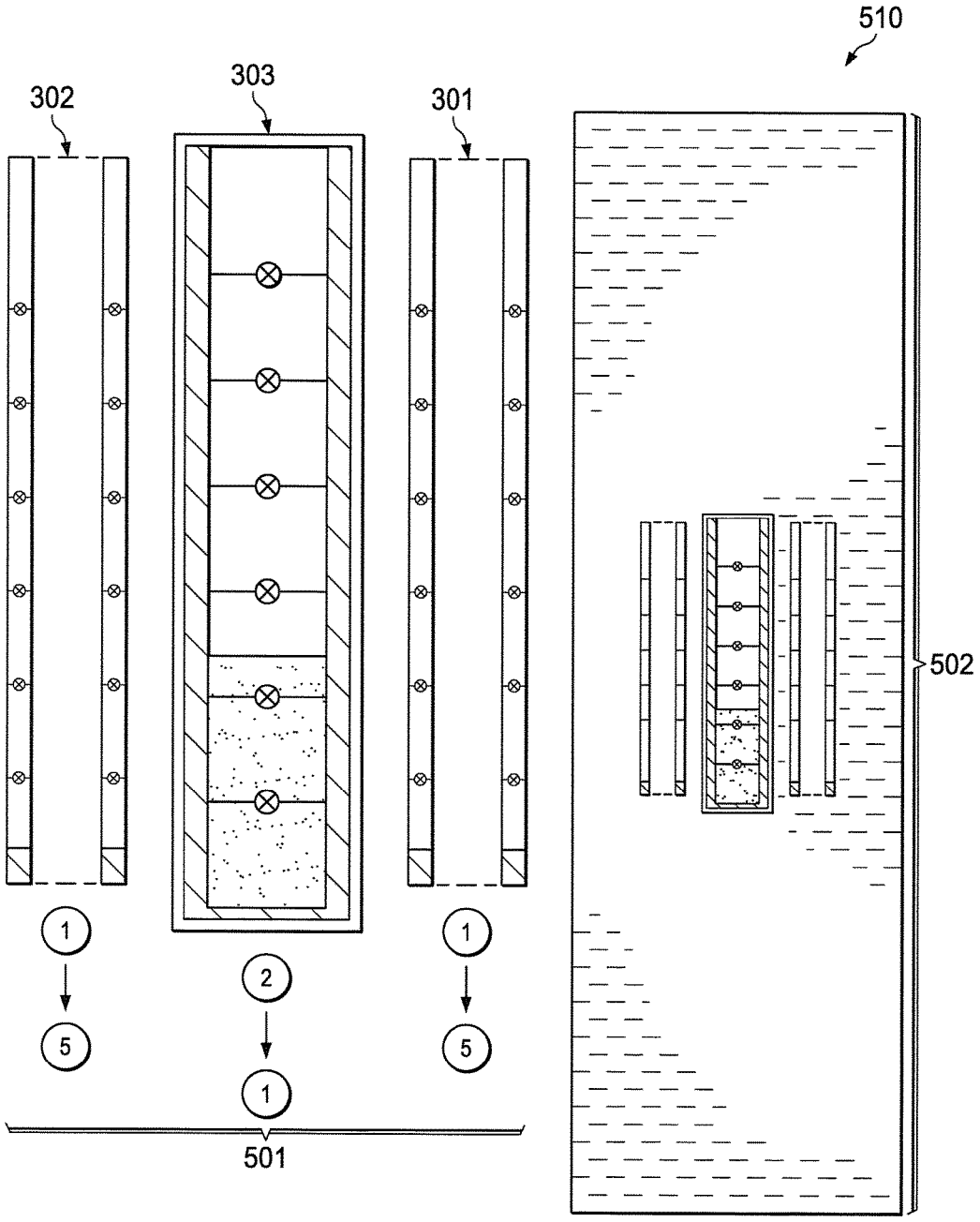

In the disposition 510 of FIG. 5B, the warm carbon dioxide gas within the annular tanks 301, 302 transfers to cold, insulated center (main) tank 303 using the differential in percent fill properties in FIG. 4 for points (1) and (2), with valves progressively closed top to bottom in the annular tanks 301, 302 and completely open in the center tank 303, keeping the annular tanks 301, 302 at a higher pressure than the center tank 303, by increasing the annular tank percent fill to regions above 100% and forcing pressures up in order to effect a transfer of the carbon dioxide gas. The tanks 301-303, the carbon dioxide gas volumes, and the valves can create very small percent fill factors to above 100%, thus creating the necessary pressures for transfer. A pressure stinger in the annular tanks 301, 302 assists with pressurization to the trans-critical region, using a fast liquid transfer pump. The transfer is a liquid transfer, siphoning from the bottom of the annular tanks 301, 302 to center tank 303, which removes some heat from the annular tanks 301, 302 although those tanks are thermally restored with 67° F. seawater. Percent fill is controlled to ensure higher pressure in the annular tanks 301, 302 until those tanks are mostly empty. Cold jacket water surrounding the main tank 303 aids in reducing center tank pressure until full, and then is exchanged with warm water and dwelled before a dive, making the center tank and jacket as warm as possible. The carbon dioxide gas in the annular tanks 301, 302 transitions from point (1) to point (5) in FIG. 4, while the carbon dioxide gas in the main tank 303 transitions from point (2) to point (1).

Figure 5C:
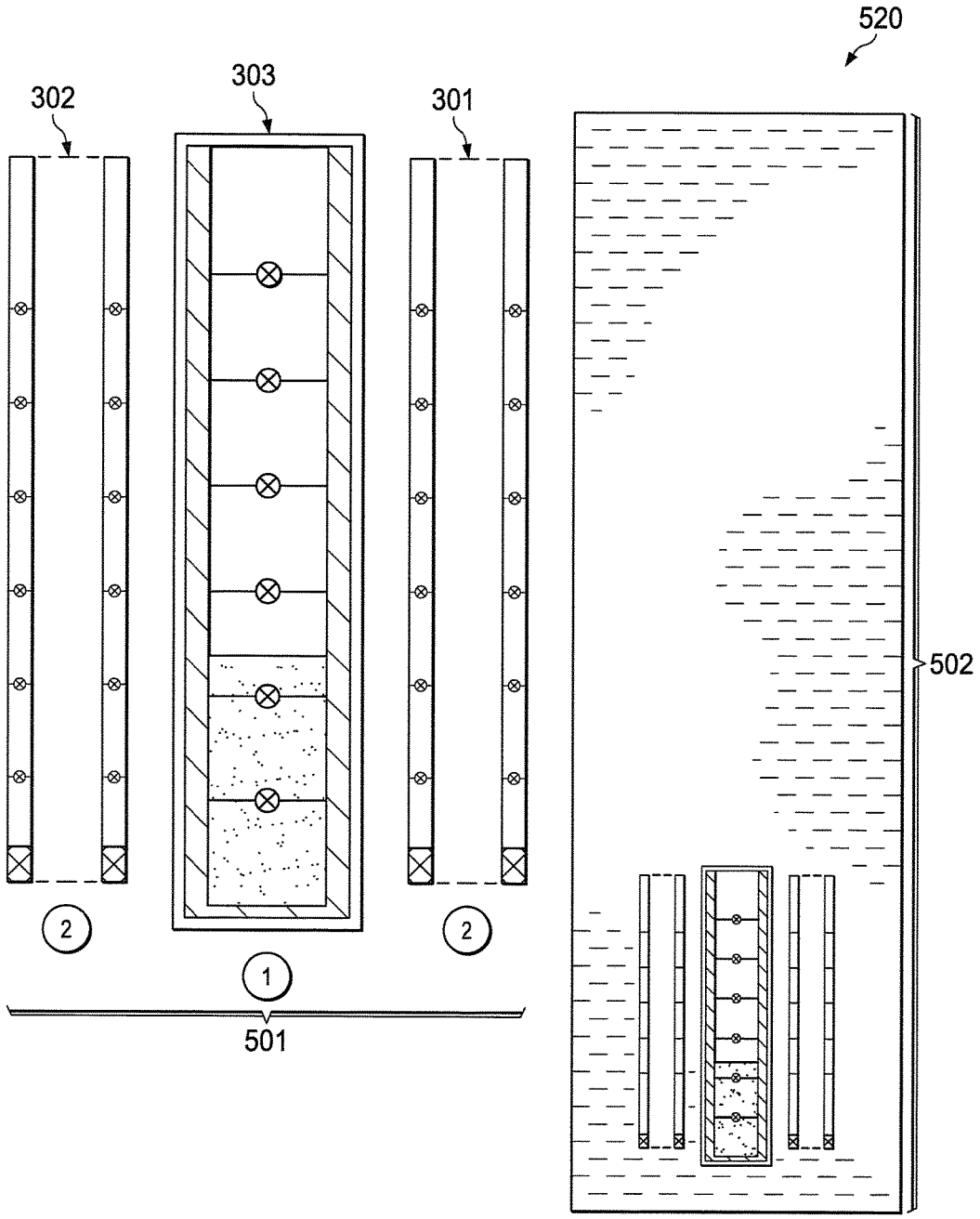

In the disposition 520 of FIG. 5C, the UUV containing the carbon dioxide cycle power generation system 300 descends to colder depths such as 1,000 meters (m), where the contents of the annular tanks 301, 302 are chilled by convection through and around the annular tanks (e.g., 5° C. seawater temperatures), but the contents of center tank 303 remain warm with the warm jacket water and insulation. At depth, the center tank valves close top to bottom, adjusting the percent fill factor to 100%, while the annular tank valves open, creating a maximized volume and minimized percent fill factor within the cold walls. The pressure in the center tank 303 adjusts to 800-900 psi, which the pressures in the now chilled annular tanks 301, 302 (with the valves all open) drops to about 300 psi. The carbon dioxide cycle power generation system 300 is now ready to send warm carbon dioxide gas through the turbine, using jacket water to supply the additional heat necessary for evaporation, and with the pressure differential employed via a choked flow through the turbine. The carbon dioxide gas in the annular tanks 301, 302 transitions to point (2) in FIG. 4, while the carbon dioxide gas in the main tank 303 remains at point (1).

Figure 5D:
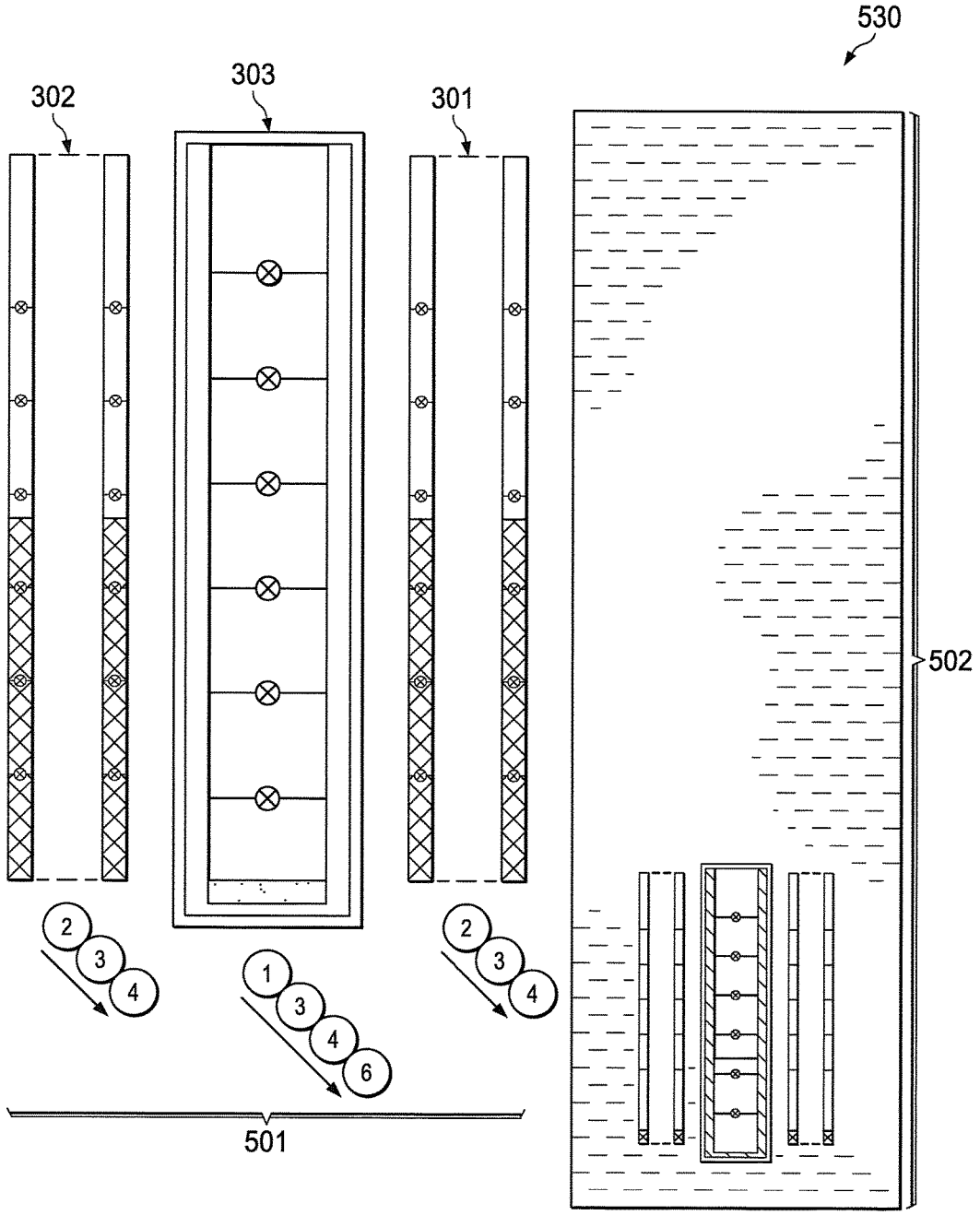

In the disposition 530 of FIG. 5D, the top valves in the center tank 303 close, increasing percent fill and pressure. As the center tanks 303 empties, the center tanks' valves progressively close from top to bottom, keeping percent fill and pressure high. The annular tanks fill, chilled, with a low percent fill and at low pressure. The center tank pressure stingers continue the pressure differential relative to the annular tanks. Warm carbon dioxide gas from the center, main tank 303 is passed through a heat exchanger (from warm surface ballast water) to control the refrigeration effect and any pressure drops just before entering and moving within the vane motor turbine. The low side of the turbine is open to the colder low pressure annular tanks 301, 302, which remain at lower percent fill factors to keep pressures low. The turbine charges the batteries of the UUV, with a charge time of about 4 hours producing 0.5-2 kW of power. The turbine may be geared through one stage, dropping revolutions per minute (RPMs) to generator levels of 1500-2000 RPM. The pulsing exit vane volume section can be pressure tapped to drive an external Helmholtz resonator and hammer/bell chirp generator, which serves as a relatively high power acoustic actuator for communications or sonar at frequencies between 1500-2500 Hertz (Hz). The carbon dioxide gas in the annular tanks 301, 302 transitions from point (2) through point (3) to point (4) in FIG. 4, while the carbon dioxide gas in the main tank 303 transitions from point (1) through point (3), and then through point (4) to point (6).

Once the center tank 303 is depleted, the batteries within the UUV should be fully charged, and communications have been made. The UUV then ascends to the surface by blowing some of the cold ballast, and perform a reconnoiter and/or an inductive power transfer to the UUV. A baseline implementation of the carbon dioxide cycle power generation system 300 contains of 100 kg of carbon dioxide and exploits a total delta head (Q) from ocean thermals, a content of 10-70 kilo Joules (kJ) of energy from typical mid to low-latitudes, per charge cycle. So configured, the carbon dioxide cycle power generation system 300 will produce charging of 1.5 kW over 1.75 hours or 3 kW of charging over 0.875 hours. The battery capacity required to store the power generated is 5 kWHr—for example, 10 volts (V) at 30 amps (A) for 0.875 hours—assuming 85% generator efficiency and 75% turbine efficiency. This baseline is approximately 25 gallons of carbon dioxide, which at 100% fill factor would require a 1.5 foot diameter by 11 foot tank, leaving 34% by volume filled with liquid carbon dioxide. Each of the annular tanks 301, 302 is individually sized slightly smaller than the main tank 303, as shown in FIG. 3.

The carbon dioxide cycle power generation system 300 is versatile as to the conversion systems that may be employed. An axial flow air turbine having multiple, very small stages and operating at higher speeds may be employed with a generator that directly drives high voltage windings, while also driving a piezo actuator. The piezo actuator may operate directly or through stored energy. An impulse turbine alternative requires larger diameter and operates at slower speeds, but is easier to manufacture, may be sealed, may be multi-stage (and is simpler to implement in multiple stages), can operate from choked flow carbon dioxide gas injectors, and operates better with high pressures. The vane rotor option described above is an established technology for 100 psi but not yet developed for 1000 psi, is sealable, may be implemented with COTS components, acts as a choked flow, is more suitable for lower pressures or miniaturization (although a larger radius may be developed), and may tap pressure pulses to drive oscillator. With a vane rotor embodiment, a Helmholtz resonator with valve springs may be driven by the carbon dioxide gas or a hydraulic line.

Figure 6:
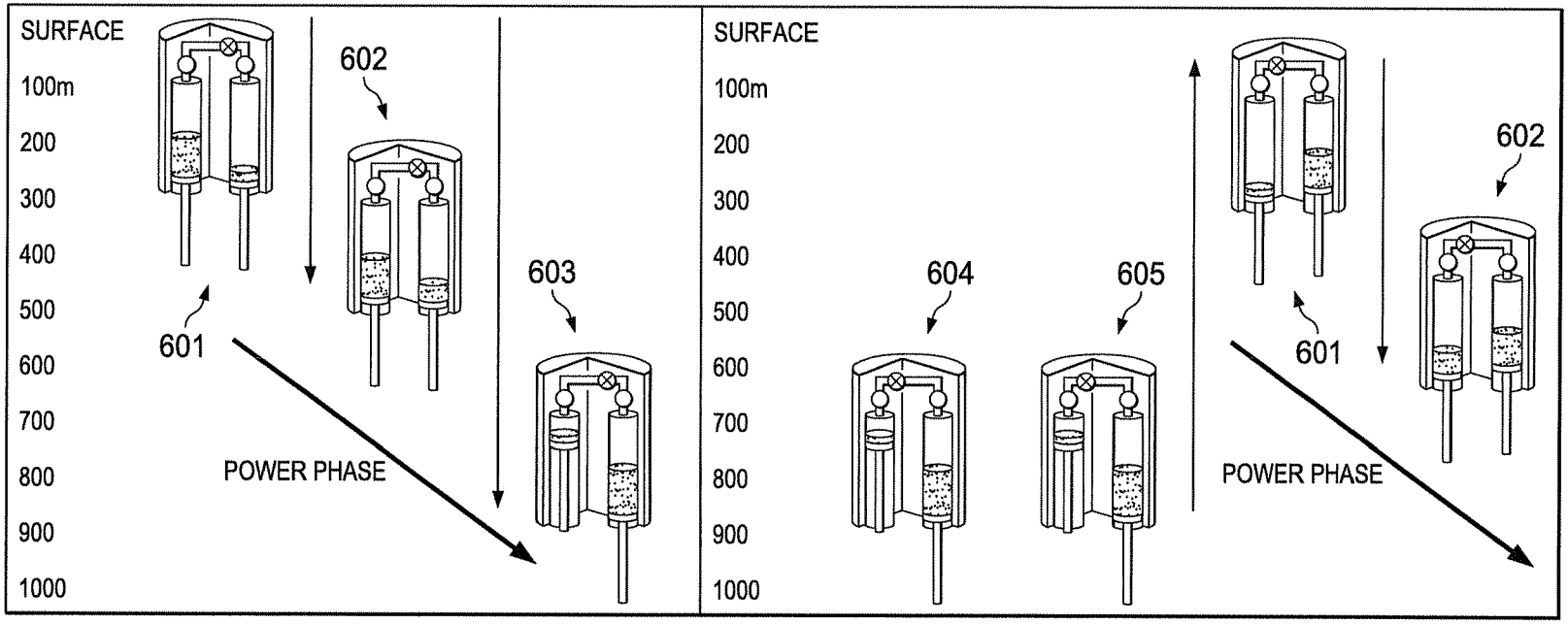
FIG. 6 illustrates a carbon dioxide power generation cycle for the implementation described in connection with FIGS. 3-4 and 5A-5D.

FIG. 6 illustrates a carbon dioxide power generation cycle for the implementation described in connection with FIGS. 3-4 and 5A-5D. In the carbon dioxide power generation cycle illustrated, the UUV is in a fully charged state 601 at shallow depths less than about 200 m. During descent, the carbon dioxide cycle power generation system within the UUV is in a power extraction state 602. The end of the power phase 603 occurs when the UUV reaches depth. At depth, the carbon dioxide cycle power generation system undergoes heat exchange 604, establishing the conditions 605 for restarting the power generation cycle. The UUV then ascends to recharge the energy storage and repeats the cycle.

Simpler implementations of a fixed volume carbon dioxide cycle power generation system do not even require use of internal valves, but instead rely on varying temperatures to send the carbon dioxide back and forth between the tanks using an orifice or precision gas needle valve. The water jackets illustrated in FIG. 6 include such an orifice. It should also be noted that the water jackets in FIG. 6 are employed for thermal ballast. In the fixed volume carbon dioxide cycle power generation systems described above using FIGS. 3-4, 5A-5D and 6, evaporation in the sending tank is less desirable than evaporation in the turbine section, or otherwise closer to the receiving (colder) tank.

Although FIG. 6 is described in connection with explanation of the carbon dioxide cycle, the diagram also illustrates a use case where a carbon dioxide cycle power generation system supplies power to an acoustic sensing system and mission described in further detail below. The acoustics employed for communications or detection must be sensed through varied depths, which makes both variants of the carbon dioxide cycle power generation systems described above well-suited for such acoustic signaling since the UUB dives and ascends on a regular basis (every 4, 6 or 8 hours, for example), with designed dive rates.

Figure 7A:
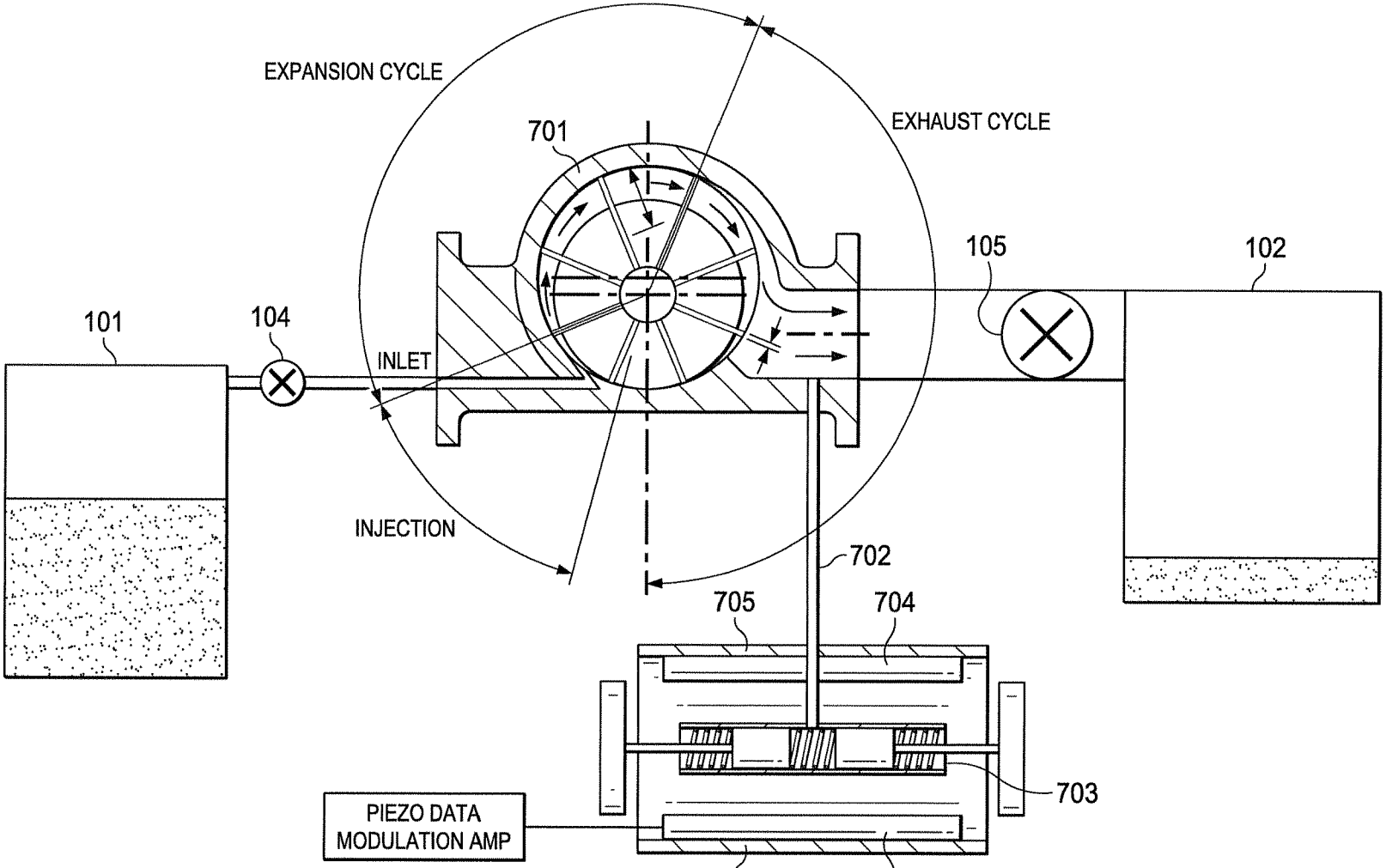
FIG. 7A depicts an implementation of two cycle chirp shift keying for communications during operation of a carbon dioxide cycle power generation system in accordance with embodiments of the present disclosure.

FIG. 7A depicts an implementation of two cycle chirp shift keying for communications during operation of a carbon dioxide cycle power generation system in accordance with embodiments of the present disclosure. The structure is illustrated in connection with the general conceptual diagrams and description found in FIGS. 1 and 1A through 1G, although those having ordinary skill in the relevant art will readily perceive the necessary adjustments for implementation with the carbon dioxide cycle power generation system depicted and described in connection with FIGS. 3-4, 5A-5D and 6. The structure employed involves a warm side body of carbon dioxide gas and/or liquid, illustrated as contained in hydraulic cylinder 101 in the example of FIG. 1, and a cold side body of carbon dioxide gas and/or liquid illustrated as contained in hydraulic cylinder 102. From the turbine portion 701 of the turbine and chirp generator 106, a pressure tap 702 draws a portion of the pressurized carbon dioxide gas flowing between hydraulic cylinders. The pressurized gas is used to drive a pulse pressure resonator 703, which is contained within an annular array 704 of higher frequency resonators bracketed by a ring Helmholtz resonator 705. The structure of FIG. 7A provides a directly driven carbon dioxide fluid acoustic modulator that may achieve power savings versus using a (battery-powered) piezo device, capable of operation to depths of 800 m. At high pressure, the carbon dioxide is near liquid in density, such that a hydraulic output at turbine to actuator may be employed for one or both of a "stiffer" link to actuator and ease in routing the line to actuator. Pulse frequencies of 500-2500 Hz for CW carrier may be produced.

Figure 7B:
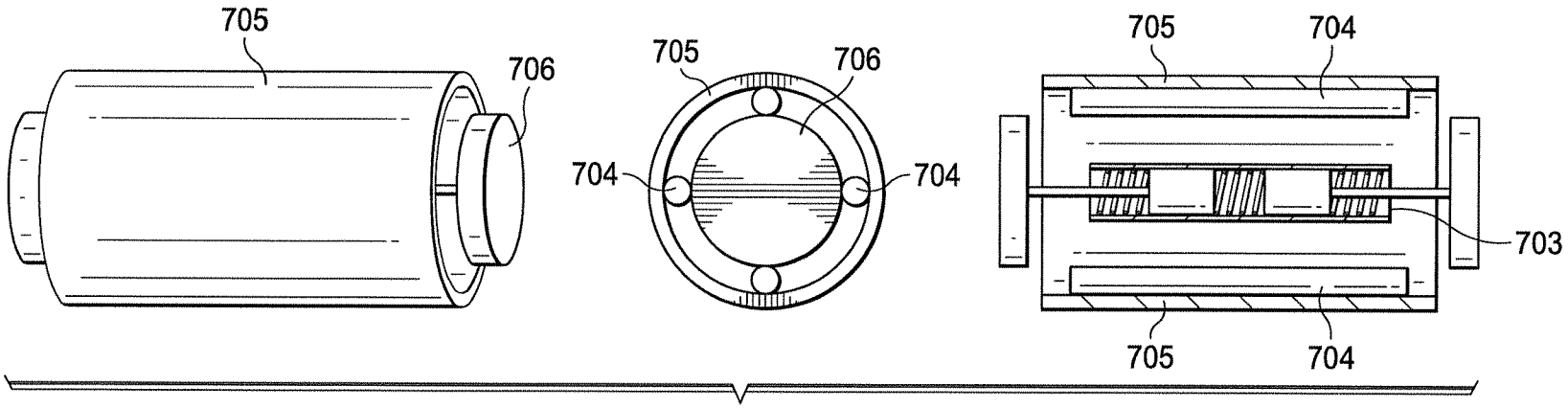
FIG. 7B depicts an implementation of a two carrier resonator for communications during operation of a carbon dioxide cycle power generation system in accordance with embodiments of the present disclosure.

FIG. 7B depicts an implementation of a two carrier resonator for communications during operation of a carbon dioxide cycle power generation system in accordance with embodiments of the present disclosure. Similar in structure to the example of FIG. 7A, the embodiment of FIG. 7B explicitly depicts that the array 704 of higher frequency resonators are implemented as piezo devices. FIG. 7B also depicts the ring Helmholtz resonator 705 as implemented by an annular bell with a hammer head 706. The design of FIG. 7B provides for acoustic coupling, is not concerned with deep operations or omnidirectional azimuth, employs a dual carrier rather than single carrier chirp, and employs an array of piezo devices rather than a single, high power piezo device.

Figure 8:
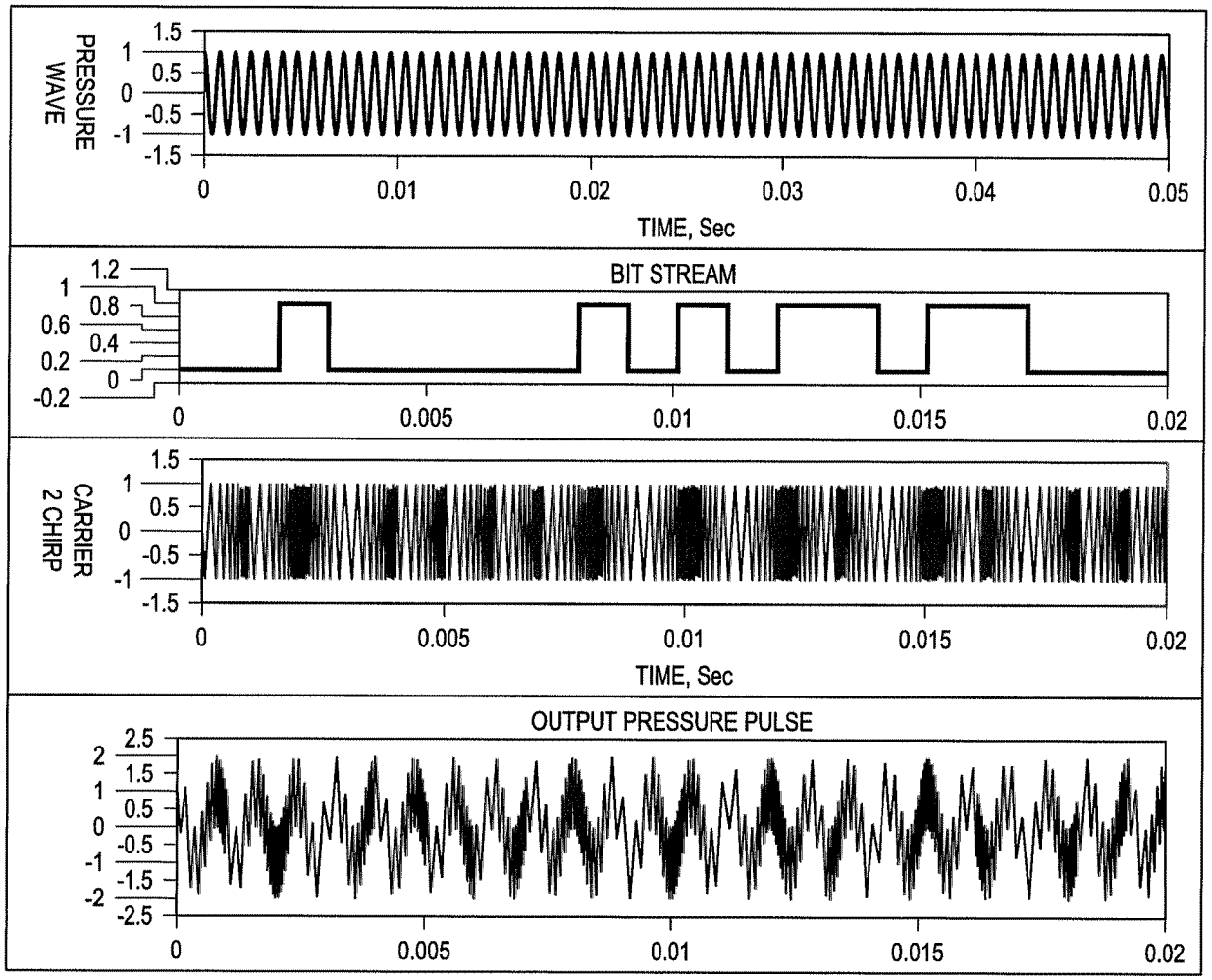
FIG. 8 illustrates signal traces for two cycle chirp shift keying for communications during operation of a carbon dioxide cycle power generation system in accordance with embodiments of the present disclosure.

FIG. 8 illustrates signal traces for two cycle chirp shift keying for communications during operation of a carbon dioxide cycle power generation system in accordance with embodiments of the present disclosure. The turbine pressure pulse is exploited as the carrier frequency for a dual frequency to drive a Helmholtz resonator and Janus-Hammer Bell. The two cycle chirp shift keying uses the carbon dioxide power cycle for the UUV, employing the 2 kHz pressure wave of that power cycle illustrated in the top signal trace in FIG. 8 as a first carrier. A second, modulated 10 KHz carrier illustrated as the second trace (from top to bottom) in FIG. 8, generated using a phase lock loop (PLL) on the first CW carrier and shift keying discriminating with digital control up-chirps or down-chirps on the second carrier. Digital information may be communicated at 100 bits per second (BPS) and 500 Hz. The resulting combined chirp signal is shown as the third trace in FIG. 8, with the corresponding output pressure pulse is shown as the bottom trace in FIG. 8. The receive process employs time reversal methods to analyze the dual carrier (interleaved). The chirp communication system enables signal transmission underwater for ranges up to 1000 nautical miles (nmi), at depths up to 1000 m. Signal range and bandwidth for chirp pulse lengths are shown in TABLE 1 below:

TABLE 1

| | Range [km] | Bandwidth [kHz] |
|---|---|---|
| Very long | >100 | <1 |
| Long | 10-100 | 1-5 |
| Medium | 1-10 | 5-20 |
| Short | 0.1-1 | 20-50 |
| Very short | <0.1 | >100 |

Because the carbon dioxide cycle generates power levels of up to 5 kW, sufficient power remains (up to 1 kW) after powering the UUV to drive the second carrier. The communication system is also suitable for pulse chirps in sonar mode. With the communications system described, the UUV will be capable of secure communications to 500 nmi, using the efficient carbon dioxide cycle as power source and capable of use with a wide band resonator for wideband jamming or charge noise self-cancelling.

Figure 9:
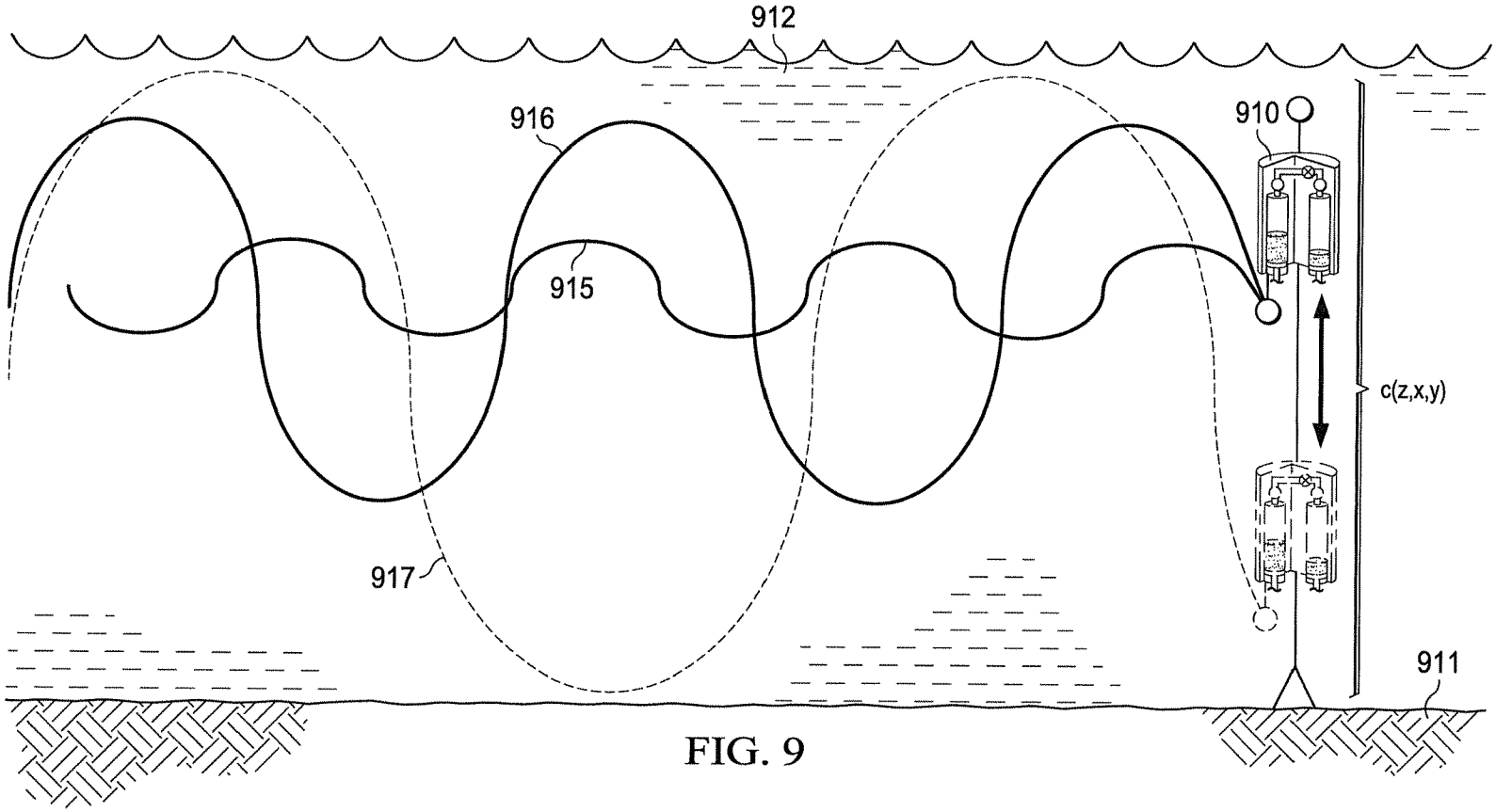
FIG. 9 illustrates use of two cycle chirp shift keying communications in a depth-variable navigation system in accordance with embodiments of the present disclosure.

FIG. 9 illustrates use of two cycle chirp shift keying communications in a depth-variable navigation system in accordance with embodiments of the present disclosure. FIG. 9 illustrates how the carbon dioxide power generation cycle may be exploited as part of providing a depth-variable navigation source or detection system. The UUV 810 containing the carbon dioxide cycle power generation system is tethered to the bottom 811, and cycles between shallow locations near the surface 812 and depth. Different depth cycles 815, 816 and 817 may be employed by the UUV 810. The UUV may switch between or among the different depth cycles 815, 816 and 817 periodically or intermittently, or may select one of the different depth cycles 815, 816 and 817 based upon a particular communications or reconnaissance function to be performed by the UUV. The depth variability provides greater environmental sampling density, better tomographic estimation in three dimensions, better group speed estimates for object detected, better geometrical distance measurements and better object location triangulation.

The ocean thermal energy conversion (OTEC) approach of the present disclosure enables long life undersea power generation from a closed carbon dioxide temperature-pressure system, enabling long endurance missions, enabling any one or more of extended UUV glider missions, establishment of a 1000 nmi or greater surveillance fence, beyond line of sight (BLOS) underwater communication, and tactically deployable pseudolite sound sources for underseas positioning system signaling. The design innovations of the present disclosure include: choked-flow control of pressure equalization, enabling optimal turbine operation; pumpless discharge conserving energy; a compact rotary vane turbine that is reliable and easy to manufacture; and a topping cycle for higher efficiency. As a power system, the carbon dioxide-based OTEC power harvesting of the present disclosure delivers total energy (kWHr) far exceeding other long endurance schemes, and in a smaller package. The Rankine cycle carbon dioxide approach allows flexible selection among electrical power generation systems. Low power flooding with an efficient topping cycle using variable volumes is used within the carbon dioxide cycle power generation system of the present disclosure.

The communications system of the present disclosure is a harmonic oscillator in which a carbon dioxide cycle-driven acoustic actuator operates as part of the carbon dioxide power cycle. A vane rotor and Helmholtz resonator tuned to a frequency band 500-2500 Hz uses two carriers for acoustic communications, creating pressure pulses on an acoustic oscillator in place of a high voltage piezo ceramic driver. Direct conversion of ocean thermals and compression are exploited for communications, with a multi-path signal using two carriers (CW and chirp) combined or interleaved for a range of 540 nmi at 500 Hz and 250 nmi at 750 Hz. The communications signaling is suitable for passive time-reversal receiving methods, operating efficiently (e.g., when directly driven rather than via stored energy) and with versatility (may either be directly driven or use stored energy).

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

The description in the present application should not be read as implying that any particular element, step, or function is an essential or critical element which must be included in the claim scope: the scope of patented subject matter is defined only by the allowed claims. Moreover, none of these claims are intended to invoke 35 USC § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

What is claimed is:

1. A carbon dioxide cycle power generation system, the system comprising:

a first carbon dioxide storage configured to store a first portion of carbon dioxide;

a second carbon dioxide storage configured to store a second portion of the carbon dioxide; and a carbon dioxide transfer connection configured to selectively direct a flow of at least part of the carbon dioxide through a turbine;

wherein the carbon dioxide cycle power generation system is configured to cycle between different underwater depths and control the carbon dioxide transfer connection in order to employ one or both of water pressure and water temperature in creating the flow of the at least part of the carbon dioxide through the turbine; and wherein each of the first and second carbon dioxide storages comprises:

a variable volume hydraulic cylinder including a movable piston; and an inlet/outlet control valve configured to selectively allow water into or out of a portion of the variable volume hydraulic cylinder.

2. The carbon dioxide cycle power generation system according to claim 1, wherein the carbon dioxide cycle power generation system is configured such that the water admitted into the portion of one of the variable volume hydraulic cylinders pressurizes one of the first and second portions of the carbon dioxide relative to the other of the first and second portions of the carbon dioxide when the carbon dioxide cycle power generation system is at a specified underwater depth.

3. The carbon dioxide cycle power generation system according to claim 1, wherein the carbon dioxide transfer connection comprises two transfer control valves and connects upper ends of the variable volume hydraulic cylinders.

4. The carbon dioxide cycle power generation system according to claim 1, wherein at least one of the first and second carbon dioxide storages further comprises an insulated, water jacketed tank configured to inhibit heat transfer between at least one of the first and second portions of the carbon dioxide and surrounding water.

5. The carbon dioxide cycle power generation system according to claim 1, wherein one or both of the first and second portions of the carbon dioxide comprise carbon dioxide liquid and carbon dioxide gas.

6. An unmanned underwater vehicle (UUV) including the carbon dioxide cycle power generation system according to claim 1, wherein the carbon dioxide cycle power generation system is configured to generate electrical power that is stored in one or more batteries within the UUV to power operation of the UUV.

7. The carbon dioxide cycle power generation system according to claim 1, wherein:

the inlet/outlet control valve is positioned below the movable piston; and the inlet/outlet control valve is configured to selectively allow the water into or out of a lower portion of the variable volume hydraulic cylinder below the movable piston.

8. A carbon dioxide cycle power generation system, the system comprising:

a first carbon dioxide storage configured to store a first portion of carbon dioxide;

a second carbon dioxide storage configured to store a second portion of the carbon dioxide;

a carbon dioxide transfer connection configured to selectively direct a flow of at least part of the carbon dioxide through a turbine, wherein the carbon dioxide cycle power generation system is configured to cycle between different underwater depths and control the carbon dioxide transfer connection in order to employ one or both of water pressure and water temperature in creating the flow of the at least part of the carbon dioxide through the turbine; and a two carrier chirp communications system coupled to the carbon dioxide transfer connection, the two carrier chirp communications system configured to employ a pulse wave of the flow of the at least part of the carbon dioxide through the turbine as a first carrier and to generate a chirp signal on a second carrier that is one of combined and interleaved with the first carrier to generate an output pressure pulse communications signal.

9. The carbon dioxide cycle power generation system according to claim 8, wherein the two carrier chirp communications system comprises a pressure pulse resonator coupled to the flow of the at least part of the carbon dioxide through the turbine, an annular array of frequency resonators adjacent the pressure pulse resonator, and a Helmholtz resonator external to the annular array of frequency resonators.

10. An unmanned underwater vehicle (UUV) including the carbon dioxide cycle power generation system according to claim 8, wherein the UUV is configured to employ the two carrier chirp communications system to transmit data to one or more remote receivers.

11. The UUV according to claim 10, wherein the UUV is tethered and configured to cycle between depths according to a selected one of a plurality of different depth cycles.

12. A method of operating a carbon dioxide cycle power generation system, the method comprising:

storing a first portion of carbon dioxide within a first carbon dioxide storage;

storing a second portion of the carbon dioxide within a second carbon dioxide storage; and operating a transfer connection between the first and second carbon dioxide storages to selectively direct a flow of at least part of the carbon dioxide through a turbine;

wherein the carbon dioxide cycle power generation system cycles between different underwater depths and employs one or both of water pressure and water temperature in creating the flow of the at least part of the carbon dioxide through the turbine; and wherein each of the first and second carbon dioxide storages comprises:

a variable volume hydraulic cylinder including a movable piston; and an inlet/outlet control valve configured to selectively allow water into or out of a portion of the variable volume hydraulic cylinder.

13. The method according to claim 12, wherein the carbon dioxide cycle power generation system is configured such that the water admitted into the portion of one of the variable volume hydraulic cylinders pressurizes one of the first and second portions of the carbon dioxide relative to the other of the first and second portions of the carbon dioxide when the carbon dioxide cycle power generation system is at a specified underwater depth.

14. The method according to claim 12, wherein the carbon dioxide transfer connection comprises two transfer control valves and connects upper ends of the variable volume hydraulic cylinders.

15. The method according to claim 12, wherein at least one of the first and second carbon dioxide storages further comprises an insulated, water jacketed tank configured to inhibit heat transfer between at least one of the first and second portions of the carbon dioxide and surrounding water.

16. The method according to claim 12, wherein one or both of the first and second portions of the carbon dioxide comprise carbon dioxide liquid and carbon dioxide gas.

17. The method according to claim 12, wherein the carbon dioxide cycle power generation system generates electrical power that is stored in one or more batteries within an unmanned underwater vehicle (UUV) including the carbon dioxide cycle power generation system, and wherein the one or more batteries power operation of the UUV.

18. The method according to claim 12, wherein:

the inlet/outlet control valve is positioned below the movable piston; and the inlet/outlet control valve is configured to selectively allow the water into or out of a lower portion of the variable volume hydraulic cylinder below the movable piston.

19. A method of operating a carbon dioxide cycle power generation system, the method comprising:

storing a first portion of carbon dioxide within a first carbon dioxide storage;

storing a second portion of the carbon dioxide within a second carbon dioxide storage;

operating a transfer connection between the first and second carbon dioxide storages to selectively direct a flow of at least part of the carbon dioxide through a turbine, wherein the carbon dioxide cycle power generation system cycles between different underwater depths and employs one or both of water pressure and water temperature in creating the flow of the at least part of the carbon dioxide through the turbine; and operating a two carrier chirp communications system that is coupled to the transfer connection, the two carrier chirp communications system employing a pulse wave of the flow of the at least part of the carbon dioxide through the turbine as a first carrier and generating a chirp signal on a second carrier that is one of combined and interleaved with the first carrier to generate an output pressure pulse communications signal.

20. The method according to claim 19, wherein the two carrier chirp communications system comprises a pressure pulse resonator coupled to the flow of the at least part of the carbon dioxide through the turbine, an annular array of frequency resonators adjacent the pressure pulse resonator, and a Helmholtz resonator external to the annular array of frequency resonators.

21. The method according to claim 19, wherein an unmanned underwater vehicle (UUV) including the carbon dioxide cycle power generation system employs the two carrier chirp communications system to transmit data to one or more remote receivers.

22. The method according to claim 21, wherein the UUV is tethered and cycles between depths according to a selected one of a plurality of different depth cycles.

* * * * *